US009498020B2

(12) United States Patent
Almeida et al.

(10) Patent No.: US 9,498,020 B2
(45) Date of Patent: Nov. 22, 2016

(54) CELL FLOW DEVICE AND METHOD THAT PROVIDES A SEQUENTIAL LINEAR FLOW OF PRESSURE RESISTANCE

(71) Applicants: Robert Scott Almeida, Boston, MA (US); Douglas Evan Stern, Providence, RI (US)

(72) Inventors: Robert Scott Almeida, Boston, MA (US); Douglas Evan Stern, Providence, RI (US)

(73) Assignee: CELLFLO, INC., Providence, RI (US)

( * ) Notice: Subject to any disclaimer, the term of this patent is extended or adjusted under 35 U.S.C. 154(b) by 5 days.

(21) Appl. No.: 14/254,062

(22) Filed: Apr. 16, 2014

(65) Prior Publication Data

US 2015/0208761 A1 Jul. 30, 2015

Related U.S. Application Data

(60) Provisional application No. 61/932,738, filed on Jan. 28, 2014.

(51) Int. Cl.

| | |
|---|---|
| ***A43B 13/20*** | (2006.01) |
| ***A43B 13/18*** | (2006.01) |
| ***A43B 17/02*** | (2006.01) |
| ***A43B 17/03*** | (2006.01) |
| ***A41D 13/015*** | (2006.01) |

(52) U.S. Cl.

CPC ..... *A43B 13/203* (2013.01); *A41D 13/0155* (2013.01); *A43B 13/189* (2013.01); *A43B 13/206* (2013.01); *A43B 17/026* (2013.01); *A43B 17/035* (2013.01); *Y10T 137/3584* (2015.04)

(58) Field of Classification Search

CPC ..... Y10T 137/7838; Y10T 137/3584; Y10T 137/36; A43B 13/20; A43B 13/203; A43B 13/206; A43B 13/188; A43B 17/03; A43B 17/035

USPC ..... 137/223, 224, 512; 36/29, 153

See application file for complete search history.

(56) References Cited

U.S. PATENT DOCUMENTS

| | | | |
|---|---|---|---|
| 506,550 | A | 10/1893 | Rosentreter |
| 2,488,382 | A | 11/1949 | Davis |
| 4,446,634 | A | 5/1984 | Johnson et al. |
| 4,688,283 | A | 8/1987 | Jacobson et al. |
| 5,313,717 | A | 5/1994 | Allen et al. |
| 5,416,986 | A | 5/1995 | Cole et al. |
| 5,898,963 | A | 5/1999 | Larson |
| 6,134,812 | A | 10/2000 | Voss |

(Continued)

FOREIGN PATENT DOCUMENTS

GB 2114425 A * 8/1983 ..... A43B 13/203

*Primary Examiner* — Michael R Reid

(74) *Attorney, Agent, or Firm* — Barlow, Josephs & Holmes, Ltd.

(57) ABSTRACT

Cell flow device and method provides a sequential linear flow of pressure resistance includes a family cell of two or more continuance cells. These continuance cells have the same or different size and shape. They also have different degrees of elastomeric capability and are in fluid connection with the advantage of a properly calibrated valve(s) and will transfer air, gas, liquid, or other substance or media, or mixture thereof by a sequential linear flow of pressure resistance from a reservoir or external source through different degrees of elastic potential energy, geometric advantages, or introduction of a force. Thereby, the family cell performs the predetermined function in any device that uses the technology for a wide array of uses for users and operators thereof.

7 Claims, 3 Drawing Sheets

(56) References Cited

U.S. PATENT DOCUMENTS

| | | | | |
|---|---|---|---|---|
| 6,282,815 | B1 | 9/2001 | Caston | |
| 6,457,262 | B1 | 10/2002 | Swigart | |
| 6,530,092 | B2 | 3/2003 | Pope | |
| 6,553,691 | B2 | 4/2003 | Huang | |
| 7,207,930 | B2 * | 4/2007 | Bonutti | A63B 21/0004 482/111 |
| 7,244,483 | B2 | 7/2007 | Tawney et al. | |
| 7,735,241 | B2 | 6/2010 | Marvin et al. | |
| 2006/0112593 | A1 | 6/2006 | Marvin et al. | |
| 2006/0272179 | A1 * | 12/2006 | Passke | A43B 7/081 36/3 B |

* cited by examiner

CELL FLOW DEVICE AND METHOD THAT PROVIDES A SEQUENTIAL LINEAR FLOW OF PRESSURE RESISTANCE

CROSS REFERENCE TO RELATED APPLICATION

This application is related to and claims priority from earlier filed Provisional Patent Application Ser. No. 61/932,738 filed Jan. 28, 2014, of which all contents thereof are incorporated herein by reference.

BACKGROUND OF THE INVENTION

The invention relates generally to cushioning, padding constructions and the component cells used therein for use in a wide array of devices such as cushion products, safety equipment, shoes and anatomical protective equipment. As part of providing a cushion or pad construction for these uses continuance cells are typically provided. They are filled with media such as gas, air, liquid or other substrate, or combination thereof to provide the needed method for whatever device the technology shall be employed.

Clearly, there is a demand and a need for a new and novel platform technology that can provide an interminable sequential linear flow of pressure resistance. This is far superior to the devices of the prior art. Such a platform technology has application in many different fields and in many different utilities, devices and methods. Currently this new and unique technology is not applied.

There have been a number of unsuccessful attempts in the prior art to address the aforementioned needs that such a method will solve. For instance, in prior art U.S. Pat. No. 5,898,963, issued to Lynn D. Larson on May 4, 1999 is illustrated "Adjustable Support Cervical Pillow". In this patent there is a static pressure resistance. In this prior art, airflow is not a sequential linear flow of pressure resistance. Its method is only employed to fill the pillows one chamber with a fixed amount of air to adjust the height of the pillow to match the needs of the operator during sleep.

Therefore, a motor-driven air pressure is inserted into one bladder, from a metal holding cylinder tank located at the top of the pillow. This is to fill the bladder with a static pressure resistance to correctly align the user's head and neck in only a side lying position. Air pressure can be removed or added by the operator by control of an air compressor motor attached to a metal air reservoir tank. This is only to provide an adjusted height to the device to match the dimensions in size of the operator while lying in a side position. There is no sequential or dynamic linear flow of pressure resistance from continuance cells of different degrees of capabilities. This embodiment is merely an air-compressed tank and an air bladder and its method is much like the inflation and deflation of a helium balloon by an air compression tank and motor. Therefore, there is a need for the novel and unique technology of the present invention to address the shortcomings and needs of the prior art.

Still further U.S. Pat. No. 7,735,241 issued to Marvin, et al., on Jun. 15, 2010 provides for a "Shoe Having An Inflatable Bladder". This utility, device and method, uses operator motion and or multiple pump embodiments to inflate multiple connected bladders in a running shoe with a static amount of air pressure.

It gives the consumer somewhat similar utility such as support and comfort however it lacks the utility, device and method of cell flow technology, which further illustrates the need for such a technology. In Marvin et al., the device "Shoe Having An Inflatable Bladder", there is no transfer of media air, gas liquid, or other substrate or mixture thereof, by a sequential linear flow of pressure resistance. It is only a series of strategically placed bladders interconnected by valves in order to uniformly fill said bladders with static air pressure. Although, there are several options to fill the multitude of bladders with a static air pressure user motion and several hand pump designs the utility, device and method is very different than that of the present invention.

The utility, device and method of Marvin, et al., fills the bladders of same capabilities and same elastic deformation with a constant equal and even air pressure which the user may determine. It's utility, device, and method does not to allow transfer of media, air, gas liquid, or other substrate or mixture thereof, by a sequential linear flow of pressure resistance from continuance cells of a family cell with different degrees of elastic potential energy always endogenously exerting different amounts of elastomeric abilities do to the different properties of the manufactured plastics that deliver different degrees of elastic deformation.

Therefore, there is a need for a new pressure resistance utility, device and method to provide such a function. The present invention meets this need as will be described in detail below.

Still further, U.S. Pat. No. 6,530,092; issued to Pope on Mar. 11, 2003 for a "Fitting And Comfort System With Inflatable Liner For Helmet" describes an "inflatable liner for a helmet. The liner has a first elongated cell and a second elongated cell extending substantially parallel to the first elongated cell. Passages extend through the first divider to permit air to pass between the first and second cells during an impact event. The second elongated cell is divided into separate sub cells and a single air inlet is provided for introducing air into the liner." In this embodiment the utility, device and method is apparently to allow a predetermined amount of static air pressure to transfer from one chamber of equal size and pressure to another chamber of equal size and pressure upon an impact event above the tolerance of the predetermined pressure of the inflated bladders.

It appears to offer some attributes such as improved comfort, fit and within this particular product it is a lighter material, thus more functional. There appears to be one or more valves to aid in the task of static air inflation and a pressure pump is provided to inflate the connected bladders together and equally fill them simultaneously. However, in reality since the two or more bladders have equal pressure, equal elastic deformation and equal finite volume it is not conceived that this utility, device and method would allow for a transfer of air between the bladders. Rather this utility, device and method is only a static filled air bladder divided into segments and sections. It is clear it does not resemble a sequential linear flow of pressure resistance such as the platform technology of the cell flow technology of the present invention.

It is an air cushion to replace other cushioning material of which certainly would be heavier in a helmet and thus less functional and desirable. There is no transfer pressure resistance through continuance cells. The given approach offered by the cell flow technology remains unique and novel.

Three other patents of interest are U.S. Pat. No. 6,553,691 B2, issued to Huang, Aug. 29 2003, U.S. Pat. No. 6,134,812 issued to Voss, Oct. 24, 2000, and U.S. Pat. No. 5,313,717, issued to Allen, May 24, 1994. The aforementioned patents have flow of media similar to a sequential linear flow of pressure resistance. However, none of the above patents have continuance cells from a family cell of two or more with different degrees of elastomeric capabilities. All bladders in the above patents are made of same materials, with same abilities, and possess same degrees of elastic deformation. Thus the potential energy of said bladders in all the previously cited patents have equal and same abilities and are not varying in degrees of abilities. Therefore, the apparatus and methods of the present invention are far superior and unique compared to the aforesaid prior art apparatus and methods.

SUMMARY OF THE INVENTION

In view of the foregoing cited patents there is a need for a new and improved platform technology with a new utility, device and method that can solve the aforementioned problems and failures associated with previous prior art devices and methods.

There is a need for an improved cell flow technology. There is a need for a platform technology that has the attendant advantages with the utility, device and method of this given technology. Cell flow technology preserves the advantages of prior art and invention and it provides new advantages not found in the prior art. This technology of the present invention will also improve many current inferior utilities, devices and methods and it will overcome many disadvantages of such currently available art and invention. Foremost cell flow technology of the present invention will allow the creation of many new utilities, devices and methods, which are unattainable without its unique new and novel properties.

For ease of discussion, the cell flow technology of the present invention may be generally separated in two sections. First, a structure is provided wherein a family cell transfers media, air, gas, liquid, or other substrate or mixture thereof, by its novel invention according to the present invention. This technology produces a sequential linear flow of pressure resistance, from two or multiple continuance cells with a varying degree of elastic potential energy to perform a desired function, in the present device that shall use the technology, for a user or operator of the technology.

Cell flow technology is comprised of two or more cells called "continuance cells". The two or more continuance cells are preferably positioned in a primary and secondary family cell geometry and are determined by the fluidity of the family cell. Specifically, the cell of origin of the media and the sequential linear flow of pressure resistance of media transfer is referred to as the primary continuance cell. The primary cell typically is provided with media from the external environment or a reservoir of media. For example, the external environment, as the source of the media, may provide air as the media. A secondary cell is not the cell of origin of the media or the sequential linear flow of pressure resistance of media transfer but is the recipient of such median and linear flow. There may be one or multiple secondary cells. These primary and secondary continuance cell form a family cell are interlocked or in fluid communication and are of the same or varying sizes and shapes, with different degree of capabilities and typically employ a properly calibrated valve(s).

Cell flow technology's function whereby; its family cell with the use of or removal of an operator force, motorized, mechanical, computerized or other form of pressure resistance, decreased pressure volume capability (unequal pressure volume capacity), greater elastic potential energy (an elastomeric advantage) or any combination of the above, or sum of the above; shall transfer media, air, gas, liquid, or other substrate or mixture thereof, in an interminable sequential linear flow of pressure resistance from and through a fluidly connected continuance cell to another or multiple fluidly connected familiar continuance cells, with the advantage of a properly calibrated valve or multiple properly calibrated valves to achieve the desired function of the device in which this technology shall be applied for any imaginable living being that shall operate the technology. This intake of media is typically from an outside entrance reservoir or the external environment and upon the conclusion of a sequential linear fluid communication between the first and second and or at least one additional continuance cell the media is exited from the family cell by a properly calibrated valve to an exit reservoir or to the external environment.

Cell flow technology of the present invention is needed and in great demand. It is noted that this technology may be used in such products but not limited to as follows. Sports equipment such as helmets including but not limited to other sports clothing such as shoes and other footgear, gloves, and body protective pads. Clothing such as shoe inserts, sandals, and any foot clothing.

Furthermore, cell flow technology utility, device and method may be used in support products that are common today such as but not limited to beds, mattresses, mattress covers, chairs and seated and recumbent furniture, pillows, and other sleep products, seated support materials such as motorized vehicle seats, aircraft seats and motor vehicle safety bumper absorbers and crumple zones.

Cell flow technology utility, device and method of the present invention will greatly impact our daily living, improve comfort, support our anatomy, improve our physiology, and improve safety. As stated above this unique platform technology is able to reach a wide audience of products in our environment. It makes these products safer and improves their function.

Further cell flow technology of the present invention with its sequential linear flow of pressure resistance will allow for improved user comfort in pillows and cushioning products and improve operator safety in protective type products such as baseball batters helmets, baseball hats for pitchers, football and ice hockey helmets skateboarding, ski and water sports helmets, and youth soccer head protectors. This technology may greatly decrease stress and strain from heel strike in stride, stabilize and support mid stance and reduce strain on toe off. Further, making an operator less susceptible to common injuries associated with exercise, daily and work activities will improve lifetime endurance and health, most particularly in all the weight bearing joints of the body. It may limit motion and secure the head with a customized, variable and adjustable superior and unique fit and further help to prevent head injuries not limited to contusions and concussions in comparison to other technology presently available and last be made of perhaps the lightest of media such as helium, making the product more functional.

A final example of how such a platform technology may improve our lives and create a safer environment is in automotive vehicle roadside safety products such as roadway transition abutment safety barriers. This technology may be used to slow a motor vehicles velocity less abruptly upon impact and decrease vehicle damage and occupant trauma by absorption of the energy created in the impact.

This platform technology of the present invention may reduce the velocity of the vehicle slower than traditional abutment barrier's, presently in place, Thus, it may absorb energy and lessen vehicle mass deformation lessening the damages of motor vehicles and lessening the injuries of motor vehicle occupants in a motor vehicle traffic accident. Multiple family cells that may further contain computerized and motorized continuance valves, which are properly and variably calibrated may accomplish this individually and collectively as a team. The multitude of continuance cells would slow the vehicle's velocity, slower than current traditional roadway transition abutment safety barriers, which more abruptly stop the motor vehicle causing great damage and injury.

BRIEF DESCRIPTION OF THE DRAWINGS

The novel features are characterized in this present technology are set forth, in the appended claims. However, some of the invention's preferred and envisioned embodiments, together with the technologies attendant advantages, may be further understood, by reference to the following brief descriptions, taken in connection with accompanying drawings of some utilities, devices and methods that this technology will be used, but not limited to, in which:

DESCRIPTION OF THE INVENTION

Figure 1:
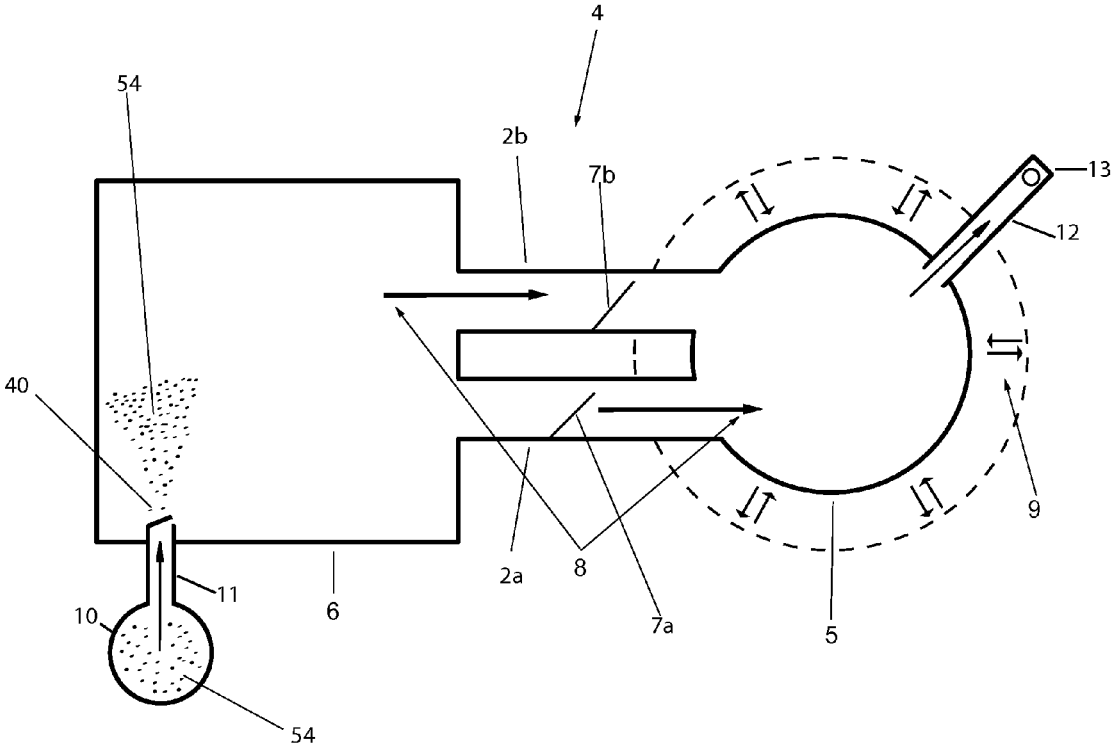
FIG. 1 illustrates a family cell of the present invention, with a primary and secondary continuance cell, with different elastic potential energies, different sizes and different geometric shapes.

In accordance with the present invention, a first embodiment of a family cell of the present invention is illustrated in FIG. 1. Referring to FIG. 1, the family cell is depicted in 4. The secondary continuance cell 5 is in the format of an unequal size, or decreased volume capability. Further illustrated is a non-congruent shaped primary cell 6. The secondary cell 5 and the primary cell 6 of this family cell 4 in FIG. 1 are connected by conduits 2*a* and 2*b* with respective properly and variable calibrated valves 7*a* and 7*b* therein. The family cell with the use of an operator, motor, or any form of pressure resistance, sequentially transfers, air, gas liquid, or other substrate or mixture thereof, with the advantage of its properly calibrated and variable valves 7*a* and 7*b* by a sequential linear flow of pressure resistance, generally referenced as 8, from the fluidly connected primary continuance cell 6 to its familiar interactive and fluidly connected secondary continuance cell 5. The secondary cell 5 has the endogenous capability of expanding and retracting as representationally shown as elastomeric ability 9.

This stretching ability or elastic deformation of the continuance cell 5 allows it to possess more elastomeric ability than its familiar continuance cell 6. One such causation for this enhanced ability may be the polyurethane used are of different thicknesses typically measured in microns, and therefore have different degrees of elastic deformation which correlates to different elastomeric advantages. So the cell 5 in FIG. 1 may be made of a thinner more elastomeric polyurethane wherein continuance cell 6 is thicker and inherently less elastomeric.

In order to fill this family cell 4 with media 54 often a tool such as a media intake pump or other inflation apparatus is used. In FIG. 1, 10 depicts a media intake pump 10 attached to the primary cell 6 (cell of origin of media 54) within the family cell 4 in this illustration by a conduit 11 or extension of the pump 10 with a flow control valve 40 therein. In the upper right portion of FIG. 1, there is attached to the secondary cell 5 a conduit or release outlet 12 that contains a pressure relief valve 13 that allows exit of media 54 from the secondary cell 5 of the family cell 4 thereby terminating the sequential linear flow of the media 54 during the operation of the family cell 4.

Figure 2:
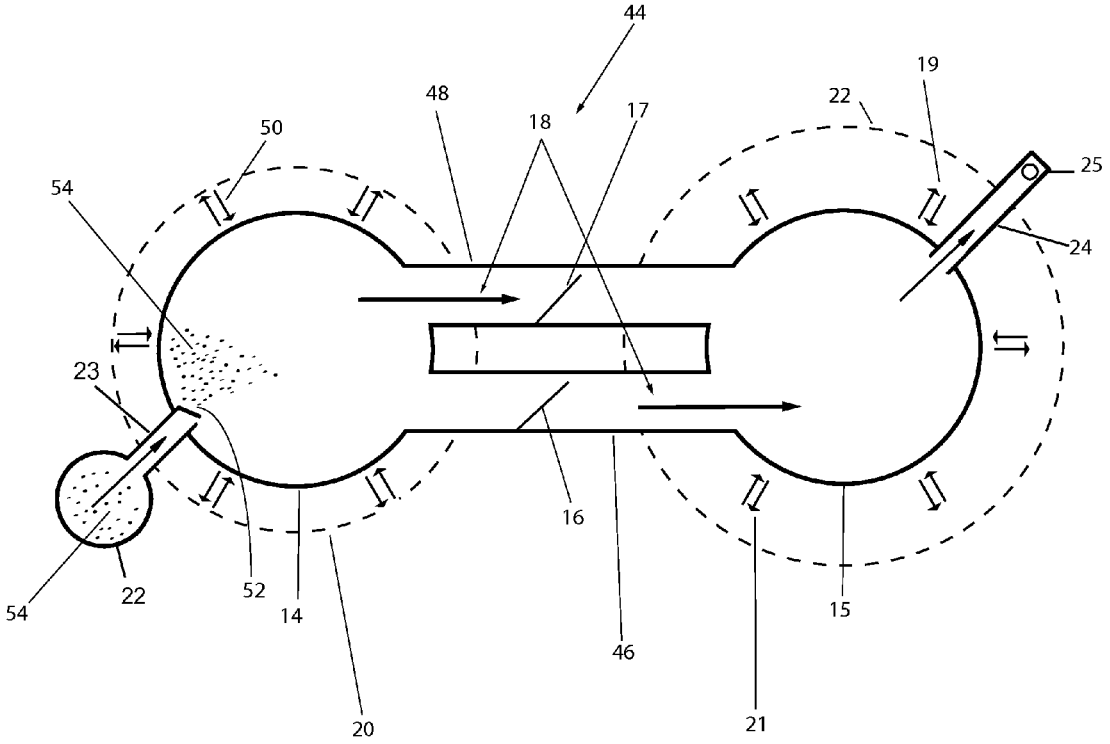
FIG. 2 illustrates an alternative embodiment of a family cell of the present invention, with equal primary and secondary continuance cells but with different degrees of elastic deformation and an unequal volume capability.

Referring to FIG. 2 is illustrated an alternative embodiment of a family cell 44 in accordance with the present invention. The family cell 44 in FIG. 2 is shown with a format of two a congruently shaped and sized continuance cells a primary cell 14 and a secondary cell 15. Shown in FIG. 2 are two properly calibrated valves 16 and 17 that reside in respective conduits 46 and 48 although it is envisioned that this technology will have some embodiments without valves 16 and 17. The conduits 46 and 48 fluidly interconnect cells and 14 and 15. The family cell 44 of FIG. 2 includes cell 15 of greater elastomeric capability 19 and cell 14 with its own lesser elastomeric capability 50.

The varying degrees of elastic deformation properties of the continuance cells will allow for a sequential flow of media from one cell another cell. In FIG. 2, continuance cell 15 will always have a greater elastic potential energy 19 than the continuance cell 14 which will always have a lesser degree of elastic potential energy 50. The performance of the elastomeric capability of the continuance cell 15 may be due to the difference in the combination of material types such as different polyurethanes of varying thickness or strengths as previously mentioned. Also, different polymer compounds may be used with advanced elastic deformation abilities, instead of a thicker same polymer compound. Thus providing an advanced polyurethane in FIG. 2. cell 15 with a greater stretching and retracting capability (elastic deformation) while retaining the same thickness in microns as its familiar continuance cell 14.

Presumably an operator, motor, or any form of pressure resistance, may transfer air, gas liquid, or other substrate or mixture thereof, with the advantage of a properly calibrated valves 16 and 17 by a sequential linear flow of pressure resistance 18, from the interlocking primary continuance cell 14 shown with a lesser capability 50 of potential elastic energy 20, to its familiar and fluidly connected secondary continuance cell 15 depicted with a greater elastic deformation ability 21. In FIG. 2, the envisioned media intake pump 22 through a media intake passage conduit 23 and valve 52 allows media to fill the primary cell 14 as the origin of media, generally referenced as 54. An exit chamber or conduit 24 channels the sequential linear flow of media 54 from the secondary cell or last continuance cell 15 in the device if there shall be more than two by an exit release valve 25 and then presumably to a storage area, container or to the outside environment such as possibly a shoe upper or the atmosphere.

Figure 3A:
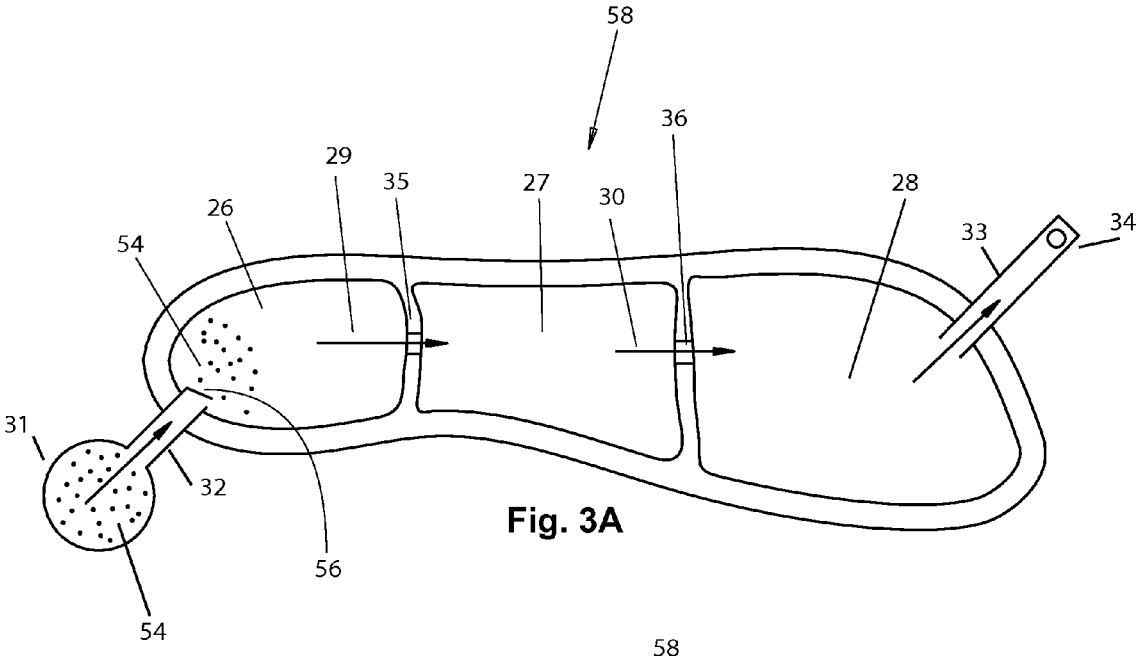
FIG. 3A illustrates a top view of a further alternative embodiment of a family cell of the present invention, with a primary and two secondary continuance cells in series all with varying degrees of elastic potential energy capabilities.
Figure 3B:
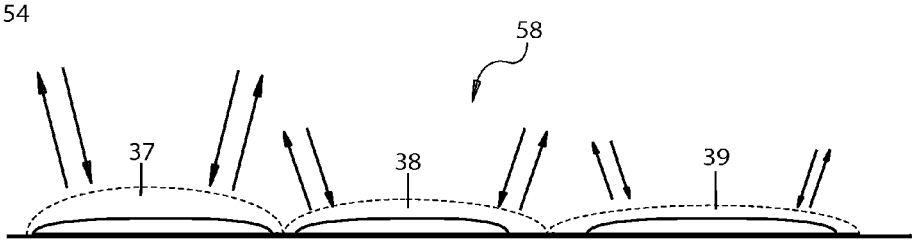
FIG. 3B shows a side view of the family cell of FIG. 3B illustration the different elastomeric capabilities of the different cells.

FIGS. 3A and 3B, show a further embodiment 58 of the present invention. FIG. 3A shows a top view of the embodiment while FIG. 3B shows a side view thereof. FIGS. 3A and 3B a number of continuance cells 26, 27, 28 with varying degrees of elastomeric potential 37, 38 and 39.

In FIGS. 3A, and 3B the continuance cells possess the same differences in elastic deformation capabilities as described above in FIG. 2. Furthermore the cause of said elastomeric abilities are the similar. In FIG. 3B there is a decrease elastomeric capability of the materials of the continuance cells from greatest in cell 26 to weakest in cell 28.

In this embodiment the continuance cells have the added capability of operator force to further media from cell 26, to 27, and then to 28. More specifically the down force of heel strike of the operator on the continuance cell 26 in FIG. 3B will together with the feature of elastic potential energy inherent to the elastic deformation 37 of said cell 26 will further the media though the envisioned embodiment which may perhaps be a shoe sole, shoe insert, or shoe bottom.

Arrows 29 and 30 represent a sequential linear flow of pressure resistances. A pressure pump 31 with media intake conduit 32 and valve 56 supplies media 54 to the first cell 26. An exit conduit 33 and pressure release valve 34, are fluidly connected to the last cell, in this case cell 28, to fill and exit the primary cell 26 of origin of sequential linear flow of pressure resistance and to cause an exit of the transfer of media 54 from the secondary continuance cells 27, 28 to perhaps the external environment or other desired location such as a shoe upper. While one primary cell and two secondary cells are shown, more than two secondary cells may be used. These primary, secondary, and another secondary continuance cells 26, 27, and 28, are connected by properly calibrated valves 35 and 36, shown in FIG. 3A. In FIG. 3A, reference 37 is representative of the elastic energy of cell 26 (having the greatest degree of elastic energy), and reference 38 is representative of the elastic energy of cell 27 (having a middle degree of elastic energy) and reference 39 (having the least amount of elastomeric energy).

More specifically, the continuance or flow of media thought cells 26, 27 and 28 will sequentially always be in the direction of least pressure. Thus, the cell with the greatest amount of elastic potential energy will always send media to the cell of least elastomeric capability. So in the situation were perhaps a value is not present, said media will continue to flow from the direction of greatest elastomeric resistance to the direction of least elastomeric resistance, or in this particular embodiment from continuance cell 26, though continuance cell 27 to continuance cell 28. In FIG. 3B it is envisioned that the cell 26 would be produced from a thicker polyurethane, than cell 27, and 28 would be made of the thinnest material of the three cells. Also it may be envisioned that the material may have equal thicknesses. It may be that they are manufactured with varying polymers that have greater and lesser abilities of elastic deformation inherently as aforementioned regarding FIGS. 1 and 2.

In accordance with the present invention, the primary and secondary cells can be made of many types of material so that the desired results are achieved. The continuance cells materials will be manufactured to have particular chemical compounding's, different thicknesses of same or different chemically structured makeups or have geometric advantages, or any combination or a sum of the above to performed the needed function in the device that shall employ the invention. These continuance cells may be composed and manufactured to possess deferent degrees of elastic deformation because of the fiber or chemical polymer ability of their materials. Further, these cells of the given invention may be made of the same polymer chemical composition with a varying degree of material thickness to deliver different amounts of elastomeric capabilities. Last the cells may be manufactured to have different pressure volume capabilities, an unequal pressure volume capacity, unique shapes, or varying sizes thereby giving one particular cell in a familiar communication an elastomeric advantage greater or lesser than its familiar counterparts of a given family cell. These component cells typically provided herein would generally be welded together using know manufacturing techniques such as but not limited to; radio frequency welding, heat sealing, and ultrasonic welding.

It would be appreciated by those skilled in the art that various changes and modifications can be made to the illustrated embodiments herein without departing from the spirit of the present given invention. All such modifications and changes are intended to be covered by the appended claims.

What is claimed is:

1. A family cell, comprising:

a first continuance cell having an input port;

a second continuance cell having an output port; the first continuance cell and the second continuance cell being in fluid communication with media flowable therebetween; the first continuance cell being configured and arranged to have an elastomeric advantage greater compared to the second continuance cell with the first continuance cell providing endogenous pressure to the media greater than the second continuance cell to the media;

a first conduit connecting the first continuance cell to the second continuance cell;

a first one-way valve positioned in the first conduit and oriented to permit one-way flow of media from the first continuance cell to the second continuance cell;

at least one additional continuance cell fluidly interconnected to the second continuance cell by a second conduit and second one-way valve therein to provide a sequential linear flow of pressure resistance of media to the at least one additional continuance cell from the second continuance cell and the at least one additional continuance cell having different elastomeric capabilities than the second continuance cell;

wherein the family cell provides a sequential linear flow of pressure resistance of media entering through the input port into the first continuance cell from a reservoir or the external environment and exited back again to the same from the second continuance cell via the output port.

2. The family cell of claim 1, wherein the continuance cells are congruent or varying in size and shape with different degrees of capability.

3. The family cell of claim 1, whereby media is dynamically transferred from the first continuance cell by any one, combination, or sum of:

decreased pressure volume capability, unequal pressure volume capacity; greater elastic potential energy; or a force such as of an operator, motorized, mechanical, computerized, or other form of pressure resistance.

4. The family cell of claim 1, whereby media is dynamically transferred from the second continuance cell or by any one, combination, or sum of:

decreased pressure volume capability, unequal pressure volume capacity; greater elastic potential energy; or a force such as of an operator, motorized, mechanical, computerized, or other form of pressure resistance.

5. The family cell of claim 1, further comprising:

a pump connected to the input port providing media into the first continuance cell.

6. The family cell of claim 1, wherein the first continuance cell, the second continuance cell and the at least one additional continuance cell each having different elastomeric capabilities than each other.

7. The family cell of claim 6, wherein the first continuance cell has a degree of elastomeric energy that is greater than the second continuance cell, which has a greater degree of elastomeric energy than the at least one additional continuance cell thereby providing sequential flow of the media from the first continuance cell to the second continuance cell to the at least one additional continuance cell.

* * * * *